United States Patent [19]

Takeda et al.

[11] Patent Number: 4,799,057

[45] Date of Patent: Jan. 17, 1989

[54] CIRCUIT FOR DRIVING A MATRIX DISPLAY DEVICE WITH A PLURALITY OF ISOLATED DRIVING BLOCKS

[75] Inventors: Makoto Takeda, Tenri; Kunihiko Yamamoto, Nara; Nobuaki Matsuhashi, Tenri; Hiroshi Take, Ikoma, all of Japan

[73] Assignee: Sharp Kabushiki Kaisha, Osaka, Japan

[21] Appl. No.: 756,267

[22] Filed: Jul. 18, 1985

[30] Foreign Application Priority Data

Jul. 23, 1984 [JP] Japan ..... 59-155051

[51] Int. Cl.[4] ..... G09G 3/36

[52] U.S. Cl. ..... 340/811; 340/784; 340/802

[58] Field of Search ..... 340/784, 789, 800, 803, 340/805, 719, 811

[56] References Cited

U.S. PATENT DOCUMENTS

| | | | |
|---|---|---|---|
| 3,848,086 | 11/1974 | Ikeda et al. | 340/800 X |
| 4,060,801 | 11/1977 | Stein et al. | 340/800 X |
| 4,113,361 | 9/1978 | Nakano | 340/800 X |
| 4,236,154 | 11/1980 | Lee | 340/805 X |
| 4,368,467 | 1/1983 | Unotoro et al. | 340/800 |
| 4,395,709 | 7/1983 | Nagae et al. | 340/811 |
| 4,447,812 | 5/1984 | Soneda et al. | 340/802 |
| 4,574,282 | 3/1986 | Crossland et al. | 340/805 X |

FOREIGN PATENT DOCUMENTS 2135099 8/1984 United Kingdom .

*Primary Examiner*—Gerald L. Brigance

*Attorney, Agent, or Firm*—Birch, Stewart, Kolasch & Birch

[57] ABSTRACT

A driving circuit for a matrix liquid crystal display device with switching transistors added to respective picture elements is divided into a plurality of blocks each of which selectively drives the switching transistors. The driving circuit is equipped with control means for actuating the blocks one by one in turn while electrically isolating the unactuated blocks from the circuit.

3 Claims, 7 Drawing Sheets

FIG. 2(A)
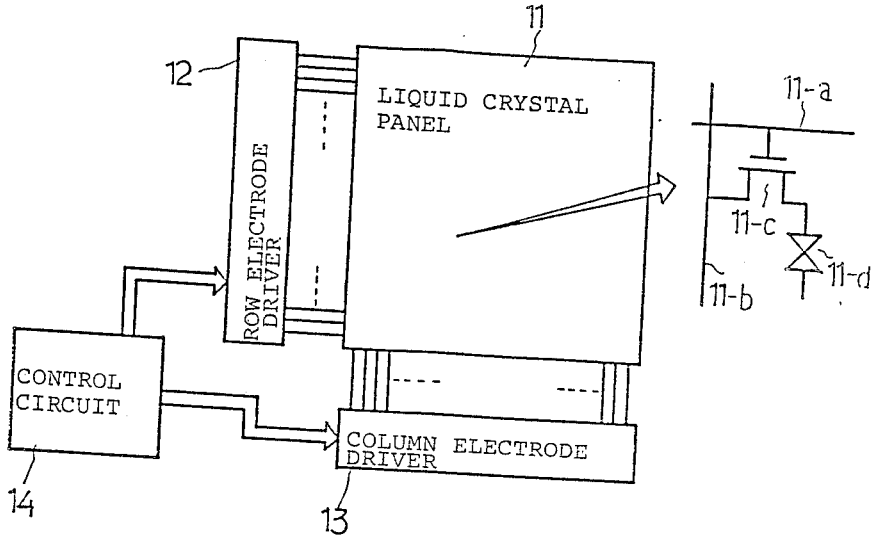
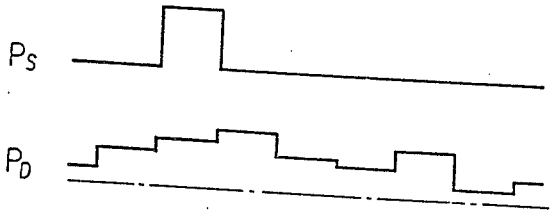
FIG. 2(B)

CIRCUIT FOR DRIVING A MATRIX DISPLAY DEVICE WITH A PLURALITY OF ISOLATED DRIVING BLOCKS

BACKGROUND OF THE INVENTION

The present invention relates to a driving circuit for a matrix liquid crystal display device in which a switching element is provided to each of an array of picture elements disposed over the display area.

A matrix liquid crystal display device, in which a group of line electrodes is arranged perpendicular to another group of line electrodes, can be operated with a low voltage and consuming little power. It is therefore widely used for character/picture display means of pocketable electronic devices. In this type of display device, however, the picture contrast deteriorates with gradual decrease of the duty factor because of crosstalk, when multiplex operation is conducted. Accordingly, it is difficult to obtain a picture of satisfactory contrast for a large capacity display. In contrast, if a switching transistor is added to each of the picture elements disposed over the display area of a matrix liquid crystal display device, the switching transistors suppress crosstalk so that, even with multiplex operation with a small duty factor, the display device provides a picture of the same clear contrast as with static operation. The matrix liquid crystal display device with switching transistors is, therefore, suitable as a large capacity display device.

The conventional driving circuit for a liquid crystal display device consumes a large amount of power for half tone display. This large power requirement makes it difficult to manufacture small liquid display devices. In addition, clock frequency increases with the volume of information to be displayed, thus multiplying the power consumption by the driving circuit.

SUMMARY OF THE INVENTION

Accordingly, it is the object of the present invention to provide a novel and useful driving circuit for a liquid crystal display device that provides display of good quality with smaller power consumption.

Other objects and further scope of applicability of the present invention will become apparent from the detailed description given hereinafter. It should be understood, however, that the detailed description of and specific examples, while indicating preferred embodiments of the invention, are given by way of illustration only, since various changes and modifications within the spirit and scope of the invention will become apparent to those skilled in the art from this detailed description.

With the above object in view, a driving circuit of the present invention, for a matrix liquid crystal display device with switching transistors added to the respective picture elements, is divided into a plurality of blocks for selectively driving said switching transistors and contains control means for actuating the blocks one by one in turn while electrically isolating the other blocks from the circuit.

Each of the driving circuits may be equipped with means for receiving a signal indicating the end of operation of the previous block and emitting a signal for starting operation, means for electrically separating the block from the circuit when operation is completed, and means for outputting an operation end-indicating signal to the next block.

The above driving circuit comprises a sampling shift register and switching circuit for sampling display signal voltage at a given amount in turn, a circuit for holding the sampled voltage for a predetermined period and a buffer circuit for outputting the held voltage to a vertical line electrode, at least said sampling shift register and switching circuit being divided into a plurality of blocks.

The above driving circuit may be designed so that its operation is started by a data pulse input into the sampling shift register and terminated by a pulse output from an additional shift register stage at the end of the sampling shift register.

BRIEF DESCRIPTION OF THE DRAWINGS

The present invention will be better understood from the detailed description given hereinbelow and the accompanying drawings which are given by way of illustration only, and thus are not limitative of the present invention and wherein.

DETAILED DESCRIPTION OF THE INVENTION

Figure 1A:
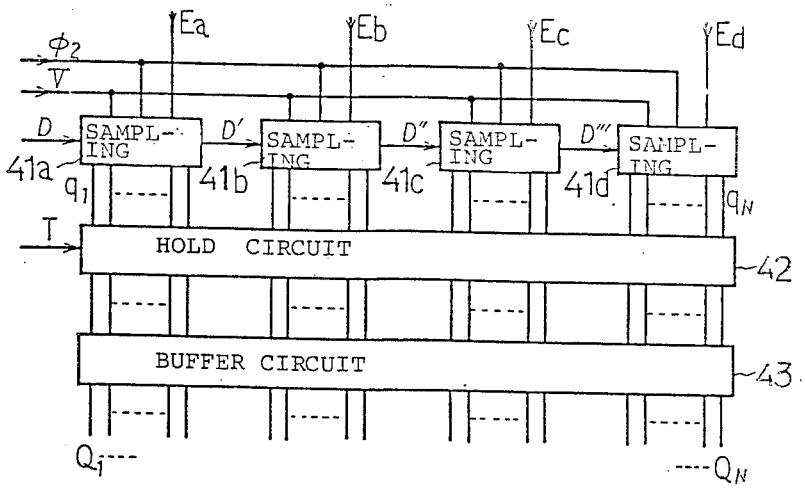
FIGS. 1(A) and (B) are a circuit block diagram and driving waveform drawing of the primary parts, respectively, of a vertical line electrode driving circuit of an embodiment of the present invention, FIGS. 2(A) and (B) are the block diagram and driving waveform drawing, respectively, of a matrix liquid crystal display device to which switching transistors are added, FIGS. 3(A) and (B) are the circuit block diagram and driving waveform drawing, respectively, of a horizontal line electrode driving circuit involved in the present invention, FIGS. 4(A) and (B) are the circuit diagram and driving waveform drawing, respectively, of a vertical line electrode driving circuit on which the vertical line electrode driving circuit of the present invention is based, FIGS. 5(A) and (B) are the circuit diagram and driving waveform drawing, respectively, of an example of the sampling circuit of the vertical line electrode driving circuit of the present invention, and FIGS. 6(A) and (B) are the circuit diagram and driving waveform drawing, respectively, of another example of the sampling circuit of the vertical line electrode driving circuit of the present invention.

The basic construction of the matrix liquid crystal display device, in which a driving circuit of the present invention is used, is described hereinbelow with reference to FIGS. 2(A) and (B).

FIG. 2(A) shows the basic circuit construction of the matrix liquid crystal display device, and FIG. 2(B) is a timing waveform drawing showing examples of signal waveforms applied to the horizontal and vertical line electrodes. In a liquid crystal display panel 11, a number of horizontal line electrodes 11-*a* cross at a right angle with a number of vertical line electrodes 11-*b* to form switching transistors 11-*c* at the intersections. The gate, source and drain electrodes of each of the swtiching transistors 11-*c* are respectively connected to one of the horizontal electrodes 11-*a*, one of the vertical electrodes 11-*b* and one of display picture element electrodes 11-*d* arranged in matrix. 12 denotes a row/or horizontal electrode driving circuit that emits a scanning pulse as indicated by "Ps" in FIG. 2(B) to the horizontal electrodes. 13 denotes a column or vertical electrode driving circuit that emits a data waveform as indicated by "$P_D$" in FIG. 2(B) to the vertical electrodes. 14 is a control circuit for operating the horizontal and vertical electrode driving circuits. In the display device of the above construction, when a scanning pulse "$P_S$" selects a certain horizontal line of the display area to turn on the switching transistors 11-*c* on that horizontal line, the voltage of the data waveform "$P_D$" corresponding to that horizontal line is supplied through the switching transistors 11-*c* to the corresponding display picture element electrodes. Thus, the voltage is applied to the portion of liquid crystal 11-*d* between the display picture element electrodes and the corresponding opposing electrodes. When said certain horizontal line is not selected by the scanning pulse, the switching transistors are turned off so that the display picture element electrodes are isolated from the vertical line electrodes. As a result, the voltage applied to the liquid crystal 11-*d* is retained without being affected by the data waveform. The above operation is repeated for all the horizontal line electrodes in turn so that a clear display pattern with no crosstalk is obtained.

The driving circuit of the present invention is characterized in that the circuit is divided into a plurality of blocks. At any given moment only a necessary block is operated with the rest being electrically isolated from the circuit so that power requirements are reduced.

The liquid crystal display device of the present invention will be further described in detail.

The liquid crystal display panel has an electrode construction such that switching elements such as thin film transistors or MOS transistors are formed on the inner side of one of the substrates constituting the display panel, each switching element being coupled with corresponding picture element electrodes and being arranged in a matrix. Each of the switching elements is positioned at each intersection of the horizontal line electrodes and the vertical line electrodes arranged at right angle to each other, and is connected to a horizontal line electrode and a vertical line electrode. The other of the substrates constituting the display panel is provided with opposing electrodes corresponding to said picture element electrodes and color filters for three primary colors (red, green and blue), if required, for each of said picture element electrodes. Field effect type liquid crystal layer such as twisted nematic liquid crystal layer is sealed between the two substrates. In response to the electric field generated, synchronous with on/off operation of the switching elements, between the picture element electrodes and the opposing electrodes, the optical property of the liquid crystal layer changes so that light amount transmitting through the liquid crystal layer varies. As a result, a display by the unit of picture elements is obtained. The horizontal line electrodes and the vertical line electrodes for on/-off control of the switching elements are connected to the horizontal electrode driving circuit and the vertical electrode driving circuit.

Figure 3A:
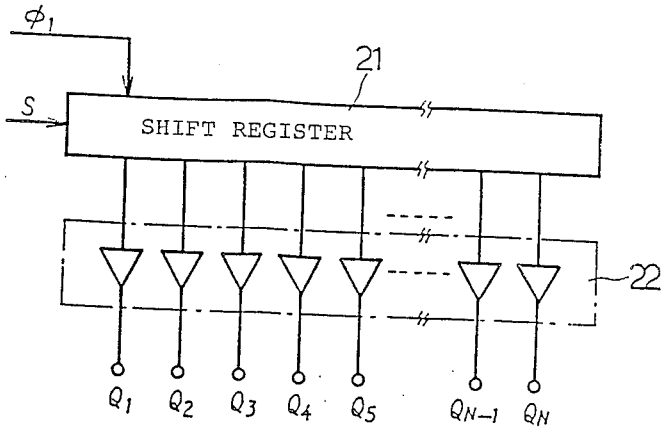

The horizontal electrode driving circuit of the construction shown in FIG. 3(A) applies scanning pulses to the horizontal line electrodes.

The horizontal electrode driving circuit for use in the present invention will now be described with reference to FIGS. 3(A) and (B).

Figure 3B:
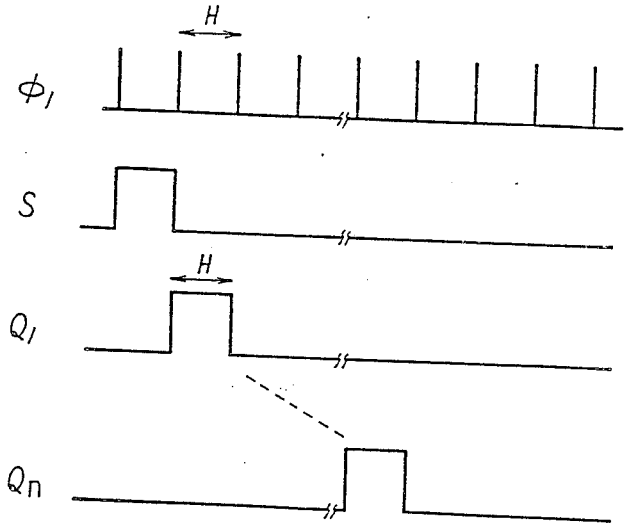

FIG. 3(A) shows the typical circuit construction of the horizontal electrode driving circuit, and FIG. 3(B) is a timing waveform drawing showing the primary voltage waveform. The horizontal electrode driving circuit mainly consists of a shift register 21 and a buffer circuit 22. It shifts a pulse "S" by a clock $\phi 1$ with the cycle of the selection period "H" corresponding to the driving duty factor, and emits scanning pulses sequentially to the horizontal electrodes through the buffer circuit 22.

Figure 1B:
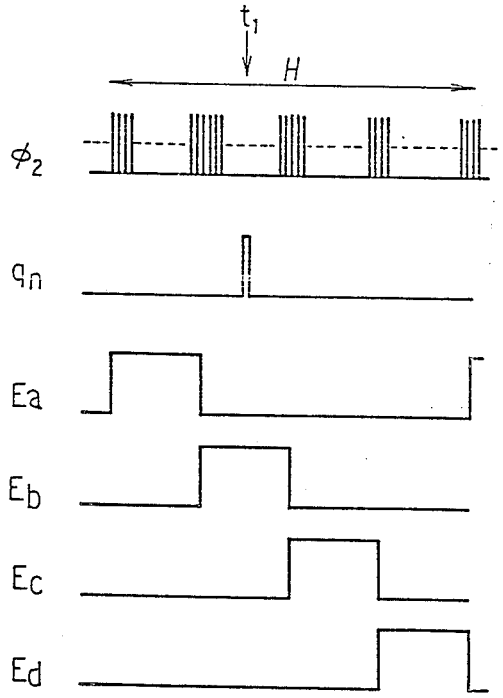

Meanwhile, the vertical electrode driving circuit applies display signals including chrominance signals to the vertical line electrodes, synchronized with the scanning pulses applied to the horizontal line electrodes. FIG. 1(A) shows the construction of the vertical electrode driving circuit in the liquid crystal display device, in an embodiment of the present invention. FIG. 1(B) is a timing waveform drawing showing the voltage waveform of the primary part of the vertical electrode driving circuit in which the sampling circuit is divided into four blocks. The number of the sampling circuit blocks may be altered as appropriate.

Referring to FIG. 1, 41 denotes a sampling circuit which is divided into four blocks 41*a*~41*d*. The operation of the blocks are controlled by control signals Ea~Ed respectively. That is, each sampling circuit block is opertated when the corresponding control signal is of high level, but is electrically separated from the circuit when the control signal is of low level. 42 and 43 denote a hold circuit and a buffer circuit respectively. At any given moment, only one of the four blocks 41*a*~41*d* conducts sampling while the rest of the blocks do not. At the moment "$t_1$" in FIG. 1(B), for example, only the block 41*b* conducts sampling. Accordingly, when the control signals of the forms indicated by Ea~Ed are supplied to the sampling circuit blocks 41*a*~41*d* so that only one block is operated at any moment, it appears as if the entire sampling circuit were operated, though actually the number of operating circuits is reduced to one fourth in average. Thus, power requirement is substantially decreased. When there is a blanking period as in television picture display, it is possible to stop the operation of all the sampling circuit blocks during the blanking period.

Prior to giving further detailed description of the vertical electrode driving circuit in the driving circuit of the present invention, a vertical electrode driving circuit on which the present invention is based will be described with reference to FIGS. 4(A) and (B).

Figure 4A:
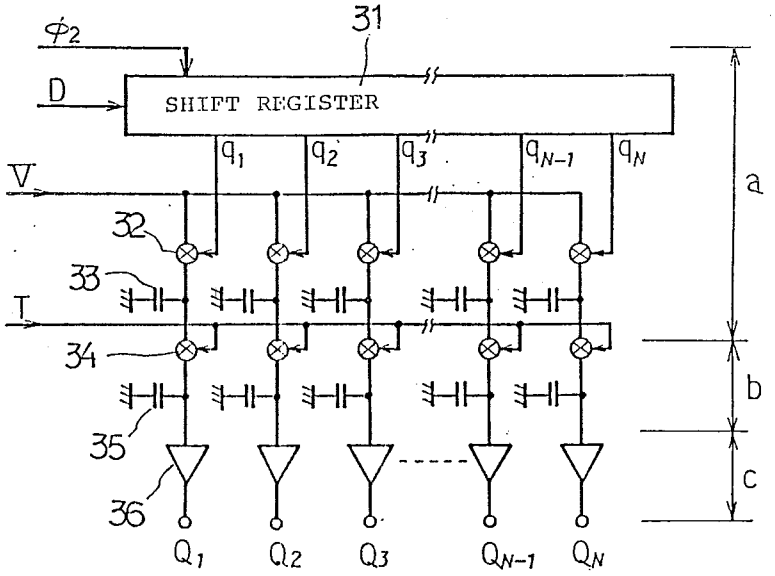
Figure 4B:
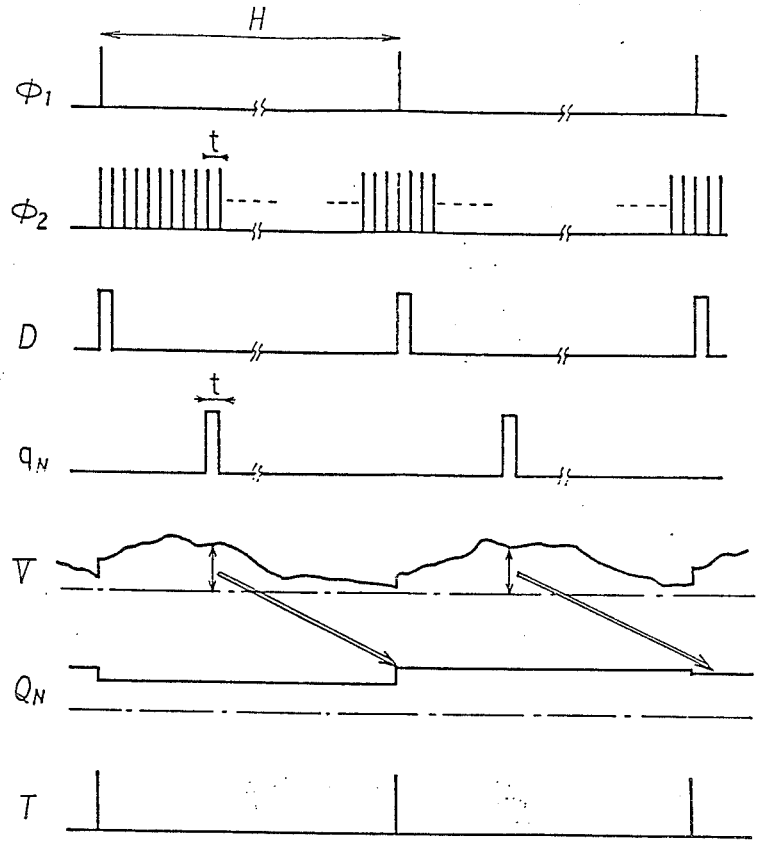

FIG. 4(A) is the block circuit construction diagram of a vertical electrode driving circuit for a half tone display such as a picture display. FIG. 4(B) is a timing waveform drawing showing the primary voltage waveform in the vertical electrode driving circuit. The portion "a" denotes a circuit section for receiving display signal voltages "V" sequentially transmitted according to the intended display content and sampling only the voltage corresponding to the display content for the picture elements in the appropriate vertical line. The circuit section "a" consists of a shift register 31, electric switches 32 and sampling condensers 33. The shift register 31 sequentially shifts a pulse "D" by a clock $\phi 2$ with the cycle of the time "t" corresponding to the time for each picture element, to turn on the switches 32 sequentially, so that the condensers 33 sample the voltage of the display signal voltage "V" at each appropriate moment. The portion "b" denotes a circuit section for holding the sampled voltage for at least one subsequent selection period (H). The circuit section "b" consists of switches 34 and holding condenser 35. The voltage sampled by the sampling condensers 33 is transferred through the switches 34 to and held by the hold condensers 35. The portion "c" is a buffer circuit for outputting the voltage held in the holding condensers 35 to the vertical line electrodes through buffer amplifiers 36.

As the result of the above operation, the voltage corresponding to each display content for each vertical line is outputted for the period of 1H to each vertical line electrode, as shown in FIG. 4(B). As mentioned earlier, the vertical electrode driving circuit for half tone display involves a fairly large number of analog circuits, resulting in increased power consumption. Moreover, increased volume of information to be displayed will cause a higher clock frequency, presumably increasing the power consumption.

Now, the vertical electrode driving circuit of the present invention will be described in detail with reference to FIGS. 5(A) and (B).

Figure 5A:
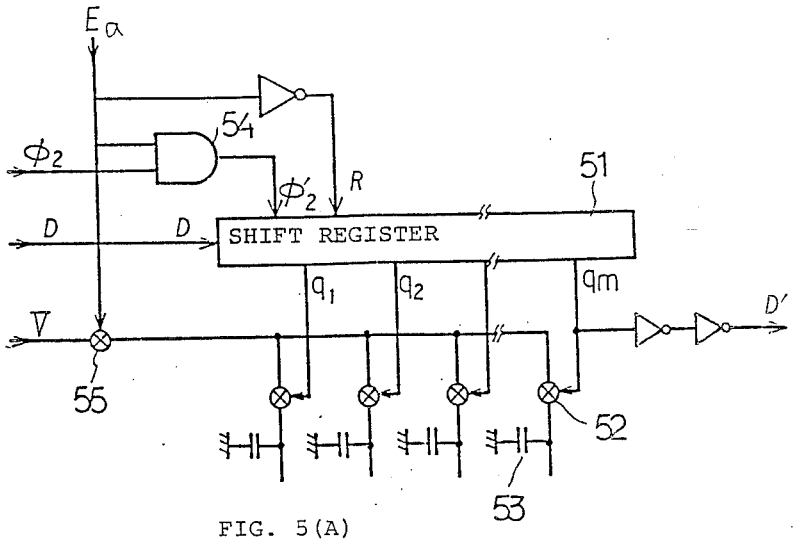
Figure 5B:
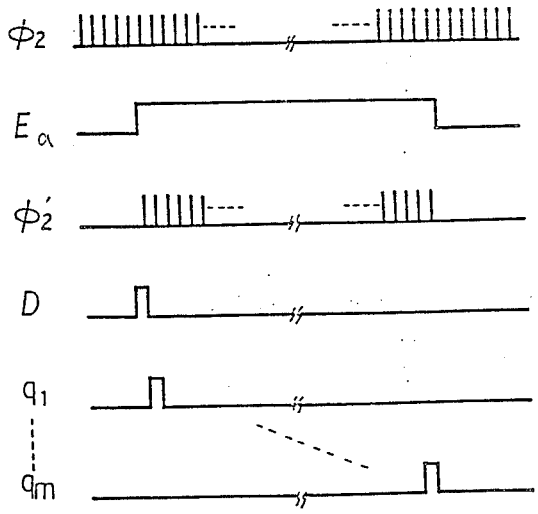

FIG. 5(A) shows an example of the actual circuit construction of one sampling circuit block 41*a* in the sampling circuit 41 shown in FIG. 1(A). FIG. 1(B) is an example of the primary driving waveform. The sampling circuit block 41*a* consists of a shift register 51, switches 52 and sampling condensers 53. In this example, the sampling circuit block is further equipped with a gate circuit 54 for terminating a clock $\phi 2$ and a switch 55 for blocking the input of display signals "V" so as to control the operation. In the circuit of the above construction, when a control signal Ea is of low level, the inputs of the clock $\phi 2$ and of the display signal "V" are blocked by the gate circuit 54 and the switch 55 respectively so that the circuit block is electrically isolated from the other circuits. In the figure, "R" denotes a reset signal for maintaining all the outputs $q_1 \sim q_m$ from the shift register at low levels while the operation is suspended. The terminals of the switches 52 on the sides connected to the sampling condensers 53 are connected to the hold circuit 42 as shown in FIG. 1(A). The hold circuit 42 may be the portion "b" in FIG. 4(A), and the buffer circuit 43 may be the portion "c" in FIG. 4(A).

Figure 6A:
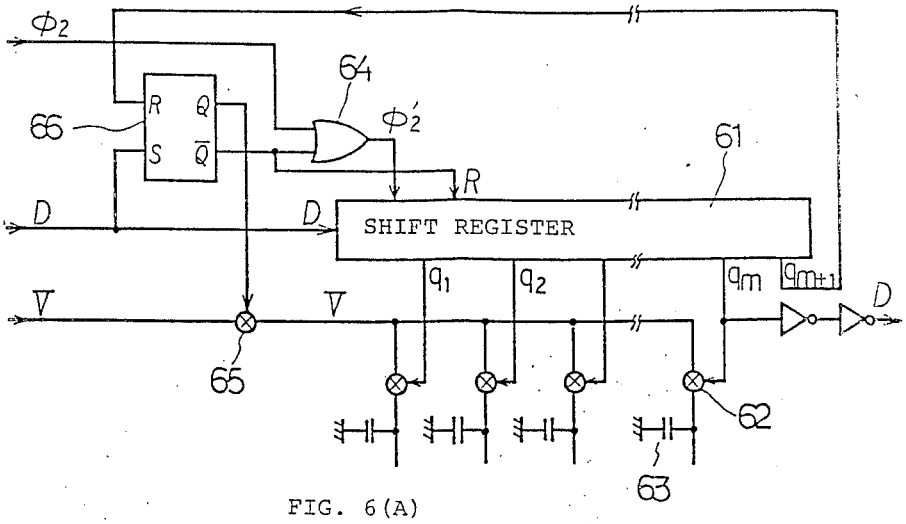
Figure 6B:
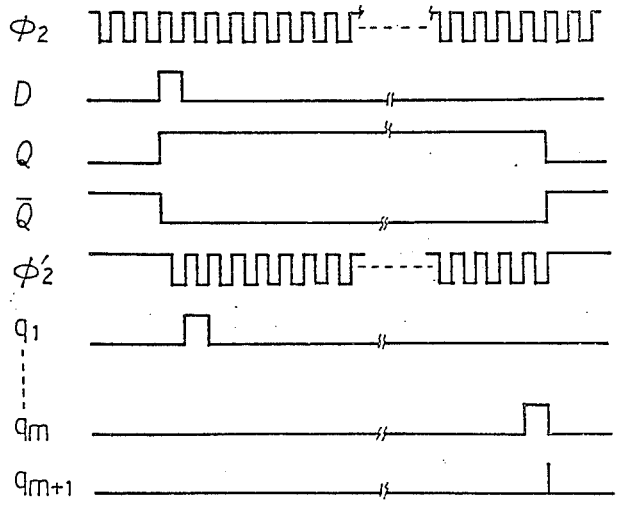

FIGS. 6(A) and (B) are another example of the sampling circuit block 41*a* in the sampling circuit 41 and its driving waveform respectively. The sampling circuit block 41*a* consists of a shift register 61, switches 62 and 65, condensers 63 and a gate circuit 64. In this example, the sampling circuit block is further equipped with a controlling flip-flop circuit 66. Further, one more stage of register is added to the final stage of the shift register 61 to detect the end of operation. When a pulse "D" (high level) to be shifted is inputted in the circuit, an output Q of high level $\overline{Q}$ changes to the one of a low level, and a clock $\phi 2$ and a display signal "V" are inputted so that the circuit starts operation. When the pulse is sequentially shifted to the final stage $q_m$, $q_m$ serves as an input pulse "D" for the next block. On receiving the pulse "D", the next circuit block starts operation. Then, with another clock, the pulse is shifted to $q_{m+1}$. As soon as the first stage of the next block reads the pulse "D'", the output of the flip-flop circuit 66 is reversed so that the inputs of the clock $\phi 2$ and display signal "V" are blocked. As a result, the shift register 61 is kept in reset state and operation is suspended. Thus, the sampling circuit of the above construction is automatically actuated by the input pulse "D" and automatically interrupted when operation is over, and therefore is a very effective driving circuit that does not require control signal inputs from an external device.

In the above examples, the invention is applied to the sampling circuit of the vertical electrode driving circuit. It is obvious from the above description that the invention is also applicable to other parts of the driving circuit, for example, to the shift register of the horizontal electrode driving circuit. Considering that the sampling circuit of the vertical electrode driving circuit requires the highest frequency for operation and therefore consumes the largest power in the driving circuit, the entire power consumption can be most effectively reduced by decreasing the power required for the sampling circuit. In this sense, the invention is the most effective when applied to the sampling circuit.

As understood from the above, the present invention realizes a power-saving driving circuit for a liquid crystal display device. The driving circuit of the present invention is extremely useful in driving a matrix liquid crystal display device for a pocketable electronic device.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A driving circuit for a matrix liquid crystal display device having a plurality of liquid crystal picture elements arranged in a matrix and a plurality of switching transistors each connected to a respective picture element, comprising:

a plurality of successive driving blocks for providing data signals to said plurality of switching transistors, each driving block including, shift register means for receiving a data pulse signal at a first input terminal thereof, a clock signal at a second input terminal thereof, and outputting said data pulse signal at successive output terminals thereof in response to said clock signal, a plurality of switching circuits each connected to a respective output terminal of said shift register means and a data voltage input terminal, and sample-and-hold means for sampling and holding a data signal from said data voltage input terminal through said switching circuits for transmission to a respective switching transistor in response to a data pulse signal applied at a respective output terminal; and control means for controlling the operation of said plurality of driving blocks including means for inhibiting said shift register means from receiving said clock signal, said control means providing control signals to said means for inhibiting such that only one driving block is operative to provide said voltage signals to said switching transistors at any one instant of time.

2. The driving circuit as claimed in claim 1, wherein said means for inhibiting comprises flip-flop means having output terminals connected to said shift register means and said data voltage input terminal, said shift register means including an additional output terminal at an end thereof for providing said data pulse signal to a reset terminal of said flip-flop means to inhibit said shift register means from receiving said clock signals and to prevent said sample-and-hold means from sampling said data signal.

3. A driving circuit for a matrix liquid crystal display device having a plurality of liquid crystal picture elements arranged in a matrix and a plurality of switching transistors each connected to a respective picture element, comprising:

a plurality of successive driving blocks for providing data signals to said plurality of switching transistors, each driving block including, shift register means for receiving a data pulse signal at a first input terminal thereof, a clock signal at a second input terminal thereof, and outputting said data pulse signal at successive output terminals thereof in response to said clock signal, a plurality of switching circuits each connected to a respective output terminal of said shift register means and a data voltage input terminal, and sample-and-hold means for sampling and holding a data signal from said data voltage input terminal through said switching circuits for transmission to a respective switching transistor in response to a data pulse signal applied at a respective output terminal; and control means for controlling the operation of said plurality of driving blocks including means for inhibiting said shift register means from receiving said clock signal, said control means providing control signals to said means for inhibiting such that only one driving block is operative to provide said voltage signals to said switching transistors at any one instant of time;

said means for inhibiting comprising flip-flop means having output terminals connected to said shift register means and said data voltage input terminal, said shift register means including an additional output terminal at an end thereof for providing said data pulse signal to a reset terminal of said flip-flop means to inhibit said shift register means from receiving said clock signals and to prevent said sample-and-hold means from sampling said data signal.

* * * * *